US009117409B2

(12) United States Patent
Koyama

(10) Patent No.: US 9,117,409 B2
(45) Date of Patent: Aug. 25, 2015

(54) LIGHT-EMITTING DISPLAY DEVICE WITH TRANSISTOR AND CAPACITOR DISCHARGING GATE OF DRIVING ELECTRODE AND OXIDE SEMICONDUCTOR LAYER

(71) Applicant: Semiconductor Energy Laboratory Co., Ltd., Atsugi-shi, Kanagawa-ken (JP)

(72) Inventor: Jun Koyama, Sagamihara (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 149 days.

(21) Appl. No.: 13/780,435

(22) Filed: Feb. 28, 2013

(65) Prior Publication Data

US 2013/0241965 A1 Sep. 19, 2013

(30) Foreign Application Priority Data

Mar. 14, 2012 (JP) ..... 2012-056909

(51) Int. Cl.
*G09G 3/34* (2006.01)
*G09G 3/32* (2006.01)

(52) U.S. Cl.
CPC ..... *G09G 3/3406* (2013.01); *G09G 3/32* (2013.01); *G09G 2300/0842* (2013.01); *G09G 2300/0852* (2013.01); *G09G 2300/0861* (2013.01)

(58) Field of Classification Search
CPC ..... G09G 3/32; G09G 3/3208; G09G 3/3233; G09G 3/325; G09G 3/3258; G09G 2300/08; G09G 2300/0809; G09G 2300/0819; G09G 2300/0842; G09G 2300/0847; G09G 2300/0861; G09G 2300/0876
USPC ..... 345/82–83
See application file for complete search history.

(56) References Cited

U.S. PATENT DOCUMENTS 5,731,856 A 3/1998 Kim et al.
5,744,864 A 4/1998 Cillessen et al.

(Continued)

FOREIGN PATENT DOCUMENTS

EP 1 459 126 9/2004
EP 1737044 A 12/2006

(Continued)

OTHER PUBLICATIONS

Fortunato.E et al., "Wide-Bandgap High-Mobility ZnO Thin-Film Transistors Produced at Room Temperature,", Appl. Phys. Lett. (Applied Physics Letters) , Sep. 27, 2004, vol. 85, No. 13, pp. 2541-2543.

(Continued)

*Primary Examiner* — Liliana Cerullo
(74) *Attorney, Agent, or Firm* — Eric J. Robinson; Robinson Intellectual Property Law Office, P.C.

(57) ABSTRACT

Display defects of a display device are suppressed. The display device includes in each pixel, a light-emitting element, a driving transistor which supplies current to the light-emitting element, and transistors in each of which a channel is formed in an oxide semiconductor layer. A transistor which controls whether to electrically connect a gate and a source of the driving transistor provided in each pixel is provided. The above transistor and a transistor which controls electrical connection between the gate of the driving transistor and another node are transistors in each of which a channel is formed in an oxide semiconductor layer. Accordingly, charge stored in the node electrically connected to the gate of the driving transistor can be arbitrarily retained or released. Consequently, display defects of the display device can be suppressed.

6 Claims, 11 Drawing Sheets

(56) References Cited

U.S. PATENT DOCUMENTS

| | | | | |
|---|---|---|---|---|
| 6,294,274 | B1 | 9/2001 | Kawazoe et al. | |
| 6,563,174 | B2 | 5/2003 | Kawasaki et al. | |
| 6,727,522 | B1 | 4/2004 | Kawasaki et al. | |
| 6,791,129 | B2 | 9/2004 | Inukai | |
| 7,049,190 | B2 | 5/2006 | Takeda et al. | |
| 7,061,014 | B2 | 6/2006 | Hosono et al. | |
| 7,064,346 | B2 | 6/2006 | Kawasaki et al. | |
| 7,105,868 | B2 | 9/2006 | Nause et al. | |
| 7,211,825 | B2 | 5/2007 | Shih et al | |
| 7,282,782 | B2 | 10/2007 | Hoffman et al. | |
| 7,297,977 | B2 | 11/2007 | Hoffman et al. | |
| 7,317,429 | B2 | 1/2008 | Shirasaki et al. | |
| 7,323,356 | B2 | 1/2008 | Hosono et al. | |
| 7,385,224 | B2 | 6/2008 | Ishii et al. | |
| 7,402,506 | B2 | 7/2008 | Levy et al. | |
| 7,411,209 | B2 | 8/2008 | Endo et al. | |
| 7,453,065 | B2 | 11/2008 | Saito et al. | |
| 7,453,087 | B2 | 11/2008 | Iwasaki | |
| 7,462,862 | B2 | 12/2008 | Hoffman et al. | |
| 7,468,304 | B2 | 12/2008 | Kaji et al. | |
| 7,501,293 | B2 | 3/2009 | Ito et al. | |
| 7,649,513 | B2 | 1/2010 | Park et al. | |
| 7,674,650 | B2 | 3/2010 | Akimoto et al. | |
| 7,732,819 | B2 | 6/2010 | Akimoto et al. | |
| 2001/0046027 | A1 | 11/2001 | Tai et al. | |
| 2002/0056838 | A1 | 5/2002 | Ogawa | |
| 2002/0132454 | A1 | 9/2002 | Ohtsu et al. | |
| 2003/0189401 | A1 | 10/2003 | Kido et al. | |
| 2003/0218222 | A1 | 11/2003 | Wager et al. | |
| 2004/0038446 | A1 | 2/2004 | Takeda et al. | |
| 2004/0127038 | A1 | 7/2004 | Carcia et al. | |
| 2005/0017302 | A1 | 1/2005 | Hoffman | |
| 2005/0057459 | A1* | 3/2005 | Miyazawa | 345/76 |
| 2005/0199959 | A1 | 9/2005 | Chiang et al. | |
| 2006/0035452 | A1 | 2/2006 | Carcia et al. | |
| 2006/0043377 | A1 | 3/2006 | Hoffman et al. | |
| 2006/0091793 | A1 | 5/2006 | Baude et al. | |
| 2006/0108529 | A1 | 5/2006 | Saito et al. | |
| 2006/0108636 | A1 | 5/2006 | Sano et al. | |
| 2006/0110867 | A1 | 5/2006 | Yabuta et al. | |
| 2006/0113536 | A1 | 6/2006 | Kumomi et al. | |
| 2006/0113539 | A1 | 6/2006 | Sano et al. | |
| 2006/0113549 | A1 | 6/2006 | Den et al. | |
| 2006/0113565 | A1 | 6/2006 | Abe et al. | |
| 2006/0169973 | A1 | 8/2006 | Isa et al. | |
| 2006/0170111 | A1 | 8/2006 | Isa et al. | |
| 2006/0197092 | A1 | 9/2006 | Hoffman et al. | |
| 2006/0208977 | A1 | 9/2006 | Kimura | |
| 2006/0228974 | A1 | 10/2006 | Thelss et al. | |
| 2006/0231882 | A1 | 10/2006 | Kim et al. | |
| 2006/0238135 | A1 | 10/2006 | Kimura | |
| 2006/0244107 | A1 | 11/2006 | Sugihara et al. | |
| 2006/0284171 | A1 | 12/2006 | Levy et al. | |
| 2006/0284172 | A1 | 12/2006 | Ishii | |
| 2006/0292777 | A1 | 12/2006 | Dunbar | |
| 2007/0024187 | A1 | 2/2007 | Shin et al. | |
| 2007/0046191 | A1 | 3/2007 | Saito | |
| 2007/0052025 | A1 | 3/2007 | Yabuta | |
| 2007/0054507 | A1 | 3/2007 | Kaji et al. | |
| 2007/0090365 | A1 | 4/2007 | Hayashi et al. | |
| 2007/0108446 | A1 | 5/2007 | Akimoto | |
| 2007/0152217 | A1 | 7/2007 | Lai et al. | |
| 2007/0172591 | A1 | 7/2007 | Seo et al. | |
| 2007/0187678 | A1 | 8/2007 | Hirao et al. | |
| 2007/0187760 | A1 | 8/2007 | Furuta et al. | |
| 2007/0194379 | A1 | 8/2007 | Hosono et al. | |
| 2007/0252928 | A1 | 11/2007 | Ito et al. | |
| 2007/0262931 | A1* | 11/2007 | Peng et al. | 345/76 |
| 2007/0272922 | A1 | 11/2007 | Kim et al. | |
| 2007/0287296 | A1 | 12/2007 | Chang | |
| 2008/0006877 | A1 | 1/2008 | Mardilovich et al. | |
| 2008/0038882 | A1 | 2/2008 | Takechi et al. | |
| 2008/0038929 | A1 | 2/2008 | Chang | |
| 2008/0050595 | A1 | 2/2008 | Nakagawara et al. | |
| 2008/0073653 | A1 | 3/2008 | Iwasaki | |
| 2008/0083950 | A1 | 4/2008 | Pan et al. | |
| 2008/0106191 | A1 | 5/2008 | Kawase | |
| 2008/0128689 | A1 | 6/2008 | Lee et al. | |
| 2008/0129195 | A1 | 6/2008 | Ishizaki et al. | |
| 2008/0166834 | A1 | 7/2008 | Kim et al. | |
| 2008/0182358 | A1 | 7/2008 | Cowdery-Corvan et al. | |
| 2008/0224133 | A1 | 9/2008 | Park et al. | |
| 2008/0254569 | A1 | 10/2008 | Hoffman et al. | |
| 2008/0258139 | A1 | 10/2008 | Ito et al. | |
| 2008/0258140 | A1 | 10/2008 | Lee et al. | |
| 2008/0258141 | A1 | 10/2008 | Park et al. | |
| 2008/0258143 | A1 | 10/2008 | Kim et al. | |
| 2008/0296568 | A1 | 12/2008 | Ryu et al. | |
| 2009/0068773 | A1 | 3/2009 | Lai et al. | |
| 2009/0073325 | A1 | 3/2009 | Kuwabara et al. | |
| 2009/0114910 | A1 | 5/2009 | Chang | |
| 2009/0134399 | A1 | 5/2009 | Sakakura et al. | |
| 2009/0152506 | A1 | 6/2009 | Umeda et al. | |
| 2009/0152541 | A1 | 6/2009 | Maekawa et al. | |
| 2009/0231241 | A1* | 9/2009 | Abe | 345/76 |
| 2009/0278122 | A1 | 11/2009 | Hosono et al. | |
| 2009/0280600 | A1 | 11/2009 | Hosono et al. | |
| 2010/0065844 | A1 | 3/2010 | Tokunaga | |
| 2010/0092800 | A1 | 4/2010 | Itagaki et al. | |
| 2010/0109002 | A1 | 5/2010 | Itagaki et al. | |
| 2013/0241431 | A1 | 9/2013 | Toyotaka et al. | |

FOREIGN PATENT DOCUMENTS

| | | | |
|---|---|---|---|
| EP | 2226847 | A | 9/2010 |
| JP | 60-198861 | A | 10/1985 |
| JP | 63-210022 | A | 8/1988 |
| JP | 63-210023 | A | 8/1988 |
| JP | 63-210024 | A | 8/1988 |
| JP | 63-215519 | A | 9/1988 |
| JP | 63-239117 | A | 10/1988 |
| JP | 63-265818 | A | 11/1988 |
| JP | 05-251705 | A | 9/1993 |
| JP | 08-264794 | A | 10/1996 |
| JP | 11-505377 | | 5/1999 |
| JP | 2000-044236 | A | 2/2000 |
| JP | 2000-150900 | A | 5/2000 |
| JP | 2002-076356 | A | 3/2002 |
| JP | 2002-289859 | A | 10/2002 |
| JP | 2003-086000 | A | 3/2003 |
| JP | 2003-086808 | A | 3/2003 |
| JP | 2003-195810 | | 7/2003 |
| JP | 2004-103957 | A | 4/2004 |
| JP | 2004-273614 | A | 9/2004 |
| JP | 2004-273732 | A | 9/2004 |
| JP | 2007-004185 | | 1/2007 |
| WO | WO-2004/114391 | | 12/2004 |

OTHER PUBLICATIONS

Dembo.H et al., "RFCPUS on Glass and Plastic Substrates Fabricated by TFT Transfer Technology,", IEDM 05: Technical Digest of International Electron Devices Meeting, Dec. 5, 2005, pp. 1067-1069.

Ikeda.T et al., "Full-Functional System Liquid Crystal Display Using CG-Silicon Technology,", SID Digest '04 : SID International Symposium Digest of Technical Papers, 2004, vol. 35, pp. 860-863.

Nomura.K et al., "Room-Temperature Fabrication of Transparent Flexible Thin-Film Transistors Using Amorphous Oxide Semiconductors,", Nature, Nov. 25, 2004, vol. 432, pp. 488-492.

Park.J et al., "Improvements in the Device Characteristics of Amorphous Indium Gallium Zinc Oxide Thin-Film Transistors by Ar Plasma Treatment,", Appl. Phys. Lett. (Applied Physics Letters) , Jun. 26, 2007, vol. 90, No. 26, pp. 262106-1-262106-3.

Takahashi.M et al., "Theoretical Analysis of IGZO Transparent Amorphous Oxide Semiconductor,", IDW '08 : Proceedings of the 15th International Display Workshops, Dec. 3, 2008, pp. 1637-1640.

Hayashi.R et al., "42.1: Invited Paper: Improved Amorphous In—Ga—Zn—O TFTS,", SID Digest '08 : SID International Symposium Digest of Technical Papers, May 20, 2008, vol. 39, pp. 621-624.

(56) References Cited

OTHER PUBLICATIONS

Prins.M et al., "A Ferroelectric Transparent Thin-Film Transistor,", Appl. Phys. Lett. (Applied Physics Letters) , Jun. 17, 1996, vol. 68, No. 25, pp. 3650-3652.
Nakamura.M et al., "The phase relations in the In2O3—Ga2ZnO4—ZnO system at 1350° C.,", Journal of Solid State Chemistry, Aug. 1, 1991, vol. 93, No. 2, pp. 298-315.
Kimizuka.N et al., "Syntheses and Single-Crystal Data of Homologous Compounds, In2O3(ZnO)m (m = 3, 4, and 5), InGaO3(ZnO)3, and Ga2O3(ZnO)m (m = 7, 8, 9, and 16) in the In2O3—ZnGa2O4—ZnO System,", Journal of Solid State Chemistry, Apr. 1, 1995, vol. 116, No. 1, pp. 170-178.
Nomura.K et al., "Thin-Film Transistor Fabricated in Single-Crystalline Transparent Oxide Semiconductor,", Science, May 23, 2003, vol. 300, No. 5623, pp. 1269-1272.
Masuda.S et al., "Transparent thin film transistors using ZnO as an active channel layer and their electrical properties,", J. Appl. Phys. (Journal of Applied Physics) , Feb. 1, 2003, vol. 93, No. 3, pp. 1624-1630.
Asakuma.N et al., "Crystallization and Reduction of Sol-Gel-Derived Zinc Oxide Films by Irradiation With Ultraviolet Lamp,", Journal of Sol-Gel Science and Technology, 2003, vol. 26, pp. 181-184.
Osada.T et al., "15.2: Development of Driver-Integrated Panel using Amorphous In—Ga—Zn—Oxide TFT,", SID Digest '09 : SID International Symposium Digest of Technical Papers, May 31, 2009, pp. 184-187.
Nomura.K et al., "Carrier transport in transparent oxide semiconductor with intrinsic structural randomness probed using single-crystalline InGaO3(ZnO)5 films,", Appl. Phys. Lett. (Applied Physics Letters) , Sep. 13, 2004, vol. 85, No. 11, pp. 1993-1995.
Li.C et al., "Modulated Structures of Homologous Compounds InMO3(ZnO)m (M=In,Ga; m=Integer) Described by Four-Dimensional Superspace Group,", Journal of Solid State Chemistry, 1998, vol. 139, pp. 347-355.
Son.K et al., "42.4L: Late-News Paper: 4 Inch QVGA AMOLED Driven by the Threshold Voltage Controlled Amorphous GIZO (Ga2O3—In2O3—ZnO) TFT,", SID Digest '08 : SID International Symposium Digest of Technical Papers, May 20, 2008, vol. 39, pp. 633-636.
Lee.J et al., "World'S Largest (15-Inch) XGA AMLCD Panel Using IGZO Oxide TFT,", SID Digest '08 : SID International Symposium Digest of Technical Papers, May 20, 2008, vol. 39, pp. 625-628.
Nowatari.H et al., "60.2: Intermediate Connector With Suppressed Voltage Loss for White Tandem OLEDS,", SID Digest '09 : SID International Symposium Digest of Technical Papers, May 31, 2009, vol. 40, pp. 899-902.
Kanno.H et al., "White Stacked Electrophosphorecent Organic Light-Emitting Devices Employing MOO3 as a Charge-Generation Layer,", Adv. Mater. (Advanced Materials), 2006, vol. 18, No. 3, pp. 339-342.
Tsuda.K et al., "Ultra Low Power Consumption Technologies for Mobile TFT-LCDs ,", IDW '02 : Proceedings of the 9th International Display Workshops, Dec. 4, 2002, pp. 295-298.
Van de Walle.C, "Hydrogen as a Cause of Doping in Zinc Oxide,", Phys. Rev. Lett. (Physical Review Letters), Jul. 31, 2000, vol. 85, No. 5, pp. 1012-1015.
Fung.T et al., "2-D Numerical Simulation of High Performance Amorphous In—Ga—Zn—O TFTs for Flat Panel Displays,", AM-FPD '08 Digest of Technical Papers, Jul. 2, 2008, pp. 251-252, The Japan Society of Applied Physics.
Jeong.J et al., "3.1: Distinguished Paper: 12.1-Inch WXGA AMOLED Display Driven by Indium—Gallium—Zinc Oxide TFTs Array,", SID Digest '08 : SID International Symposium Digest of Technical Papers, May 20, 2008, vol. 39, No. 1, pp. 1-4.
Park.J et al., "High performance amorphous oxide thin film transistors with self-aligned top-gate structure,", IEDM 09: Technical Digest of International Electron Devices Meeting, Dec. 7, 2009, pp. 191-194.
Kurokawa.Y et al., "UHF RFCPUS on Flexible and Glass Substrates for Secure RFID Systems,", Journal of Solid-State Circuits , 2008, vol. 43, No. 1, pp. 292-299.
Ohara.H et al., "Amorphous In—Ga—Zn—Oxide TFTs with Suppressed Variation for 4.0 inch QVGA AMOLED Display,", AM-FPD '09 Digest of Technical Papers, Jul. 1, 2009, pp. 227-230, The Japan Society of Applied Physics.
Coates.D et al., "Optical Studies of the Amorphous Liquid-Cholesteric Liquid Crystal Transition:The "Blue Phase",", Physics Letters, Sep. 10, 1973, vol. 45A, No. 2, pp. 115-116.
Cho.D et al., "21.2:AL and SN-Doped Zinc Indium Oxide Thin Film Transistors for AMOLED Back-Plane,", SID Digest '09 : SID International Symposium Digest of Technical Papers, May 31, 2009, pp. 280-283.
Lee.M et al., "15.4:Excellent Performance of Indium—Oxide-Based Thin-Film Transistors by DC Sputtering,", SID Digest '09 : SID International Symposium Digest of Technical Papers, May 31, 2009, pp. 191-193.
Jin.D et al., "65.2:Distinguished Paper:World-Largest (6.5") Flexible Full Color Top Emission AMOLED Display on Plastic Film and Its Bending Properties,", SID Digest '09 : SID International Symposium Digest of Technical Papers, May 31, 2009, pp. 983-985.
Sakata.J et al., "Development of 4.0-In. AMOLED Display With Driver Circuit Using Amorphous In—Ga—Zn—Oxide TFTS,", IDW '09 : Proceedings of the 16th International Display Workshops, 2009, pp. 689-692.
Park.J et al., "Amorphous Indium—Gallium—Zinc Oxide TFTS and Their Application for Large Size AMOLED,", AM-FPD '08 Digest of Technical Papers, Jul. 2, 2008, pp. 275-278.
Park.S et al., "Challenge to Future Displays: Transparent AM-OLED Driven by Peald Grown ZnO TFT,", IMID '07 Digest, 2007, pp. 1249-1252.
Godo.H et al., "Temperature Dependence of Characteristics and Electronic Structure for Amorphous In—Ga—Zn—Oxide TFT,", AM-FPD '09 Digest of Technical Papers, Jul. 1, 2009, pp. 41-44.
Osada.T et al., "Development of Driver-Integrated Panel Using Amorphous In—Ga—Zn—Oxide TFT,", AM-FPD'09 Digest of Technical Papers, Jul. 1, 2009, pp. 33-36.
Hirao.T et al., "Novel Top-Gate Zinc Oxide Thin-Film Transistors (ZnO TFTS) for AMLCDS,", Journal of the SID, 2007, vol. 15, No. 1, pp. 17-22.
Hosono.H, "68.3:Invited Paper:Transparent Amorphous Oxide Semiconductors for High Performance TFT,", SID Digest '07 : SID International Symposium Digest of Technical Papers, 2007, vol. 38, pp. 1830-1833.
Godo.H et al., "P-9:Numerical Analysis on Temperature Dependence of Characteristics of Amorphous In—Ga—Zn—Oxide TFT,", SID Digest '09 : SID International Symposium Digest of Technical Papers, May 31, 2009, pp. 1110-1112.
Ohara.H et al., "21.3:4.0 In. QVGA AMOLED Display Using In—Ga—Zn—Oxide TFTS With a Novel Passivation Layer,", SID Digest '09 : SID International Symposium Digest of Technical Papers, May 31, 2009, pp. 284-287.
Miyasaka.M, "SUFTLA Flexible Microelectronics on Their Way to Business,", SID Digest '07 : SID International Symposium Digest of Technical Papers, 2007, vol. 38, pp. 1673-1676.
Chern.H et al., "An Analytical Model for the Above-Threshold Characteristics of Polysilicon Thin-Film Transistors,", IEEE Transactions on Electron Devices, Jul. 1, 1995, vol. 42, No. 7, pp. 1240-1246.
Kikuchi.H et al., "39.1:Invited Paper:Optically Isotropic Nano-Structured Liquid Crystal Composites for Display Applications,", SID Digest '09 : SID International Symposium Digest of Technical Papers, May 31, 2009, pp. 578-581.
Asaoka.Y et al., "29.1:Polarizer-Free Reflective LCD Combined With Ultra Low-Power Driving Technology,", SID Digest '09 : SID International Symposium Digest of Technical Papers, May 31, 2009, pp. 395-398.
Lee.H et al., "Current Status of, Challenges to, and Perspective View of AM-OLED ,", IDW '06 : Proceedings of the 13th International Display Workshops, Dec. 7, 2006, pp. 663-666.
Kikuchi.H et al., "62.2:Invited Paper:Fast Electro-Optical Switching in Polymer-Stabilized Liquid Crystalline Blue Phases for Display

(56) References Cited

OTHER PUBLICATIONS

Application,", SID Digest '07 : SID International Symposium Digest of Technical Papers, 2007, vol. 38, pp. 1737-1740.
Nakamura.M, "Synthesis of Homologous Compound with New Long-Period Structure,", NIRIM Newsletter, Mar. 1, 1995, vol. 150, pp. 1-4.
Kikuchi.H et al., "Polymer-Stabilized Liquid Crystal Blue Phases,", Nature Materials, Sep. 2, 2002, vol. 1, pp. 64-68.
Kimizuka.N et al., "Spinel,YBFE2O4, and YB2FE3O7 Types of Structures for Compounds in the IN2O3 and SC2O3—A2O3—BO Systems [A; Fe, Ga, or Al; B: Mg, Mn, Fe, Ni, Cu,or Zn] at Temperatures Over 1000° C.,", Journal of Solid State Chemistry, 1985, vol. 60, pp. 382-384.
Kitzerow.H et al., "Observation of Blue Phases in Chiral Networks,", Liquid Crystals, 1993, vol. 14, No. 3, pp. 911-916.
Costello.M et al., "Electron Microscopy of a Cholesteric Liquid Crystal and Its Blue Phase,", Phys. Rev. A (Physical Review. A), May 1, 1984, vol. 29, No. 5, pp. 2957-2959.
Meiboom.S et al., "Theory of the Blue Phase of Cholesteric Liquid Crystals,", Phys. Rev. Lett. (Physical Review Letters), May 4, 1981, vol. 46, No. 18, pp. 1216-1219.
Park.Sang-Hee et al., "42.3: Transparent ZnO Thin Film Transistor for the Application of High Aperture Ratio Bottom Emission AM-OLED Display,", SID Digest '08 : SID International Symposium Digest of Technical Papers, May 20, 2008, vol. 39, pp. 629-632.
Orita.M et al., "Mechanism of Electrical Conductivity of Transparent InGaZnO4,", Phys. Rev. B (Physical Review. B), Jan. 15, 2000, vol. 61, No. 3, pp. 1811-1816.
Nomura.K et al., "Amorphous Oxide Semiconductors for High-Performance Flexible Thin-Film Transistors,", Jpn. J. Appl. Phys. (Japanese Journal of Applied Physics) , 2006, vol. 45, No. 5B, pp. 4303-4308.
Janotti.A et al., "Native Point Defects in ZnO,", Phys. Rev. B (Physical Review. B), Oct. 4, 2007, vol. 76, No. 16, pp. 165202-1-165202-22.
Park.J et al., "Electronic Transport Properties of Amorphous Indium—Gallium—Zinc Oxide Semiconductor Upon Exposure to Water,", Appl. Phys. Lett. (Applied Physics Letters) , 2008, vol. 92, pp. 072104-1-072104-3.
Hsieh.H et al., "P-29:Modeling of Amorphous Oxide Semiconductor Thin Film Transistors and Subgap Density of States,", SID Digest '08: SID International Symposium Digest of Technical Papers, 2008, vol. 39, pp. 1277-1280.
Janotti.A et al., "Oxygen Vacancies in ZnO,", Appl. Phys. Lett. (Applied Physics Letters) , 2005, vol. 87, pp. 122102-1-122102-3.
Oba.F et al., "Defect energetics in ZnO: A hybrid Hartree-Fock density functional study,", Phys. Rev. B (Physical Review. B), 2008, vol. 77, pp. 245202-1-245202-6.
Orita.M et al., "Amorphous transparent conductive oxide InGaO3(ZnO)m (m<4):a Zn4s conductor,", Philosophical Magazine, 2001, vol. 81, No. 5, pp. 501-515.
Hosono.H et al., "Working hypothesis to explore novel wide band gap electrically conducting amorphous oxides and examples,", J. Non-Cryst. Solids (Journal of Non-Crystalline Solids), 1996, vol. 198-200, pp. 165-169.
Mo.Y et al., "Amorphous Oxide TFT Backplanes for Large Size AMOLED Displays,", IDW '08 : Proceedings of the 6th International Display Workshops, Dec. 3, 2008, pp. 581-584.
Kim.S et al., "High-Performance oxide thin film transistors passivated by various gas plasmas,", 214th ECS Meeting, 2008, No. 2317, ECS.
Clark.S et al., "First Principles Methods Using CASTEP,", Zeitschrift fur Kristallographie, 2005, vol. 220, pp. 567-570.
Lany.S et al., "Dopability, Intrinsic Conductivity, and Nonstoichiometry of Transparent Conducting Oxides,", Phys. Rev. Lett. (Physical Review Letters), Jan. 26, 2007, vol. 98, pp. 045501-1-045501-4.
Park.J et al., "Dry etching of ZnO films and plasma-induced damage to optical properties,", J. Vac. Sci. Technol. B (Journal of Vacuum Science & Technology B), Mar. 1, 2003, vol. 21, No. 2, pp. 800-803.
Oh.M et al., "Improving the Gate Stability of ZnO Thin-Film Transistors With Aluminum Oxide Dielectric Layers,", J. Electrochem. Soc. (Journal of the Electrochemical Society), 2008, vol. 155, No. 12, pp. H1009-H1014.
Ueno.K et al., "Field-Effect Transistor on SrTiO3 With Sputtered AI2O3 Gate Insulator,", Appl. Phys. Lett. (Applied Physics Letters), Sep. 1, 2003, vol. 83, No. 9, pp. 1755-1757.

* cited by examiner

Period A

Period B

Period C

Reset Period

Period A

Period B

Period C

Reset Period

LIGHT-EMITTING DISPLAY DEVICE WITH TRANSISTOR AND CAPACITOR DISCHARGING GATE OF DRIVING ELECTRODE AND OXIDE SEMICONDUCTOR LAYER

BACKGROUND OF THE INVENTION

1. Field of the Invention

The present invention relates to a display device. Specifically, the present invention relates to an active matrix display device provided with a transistor which is provided in each pixel and includes a channel formed in an oxide semiconductor layer.

2. Description of the Related Art

Since display devices using light-emitting elements have high visibility, are suitable for reduction in thickness, and do not have limitations on viewing angles, they have attracted attention as display devices which can take the place of CRTs (cathode ray tubes) or liquid crystal display devices. Specifically proposed structures of active matrix display devices using light-emitting elements are different depending on manufacturers. However, in general, at least a light-emitting element, a transistor which controls input of video signals to pixels, and a transistor (a driving transistor) which controls current supplied to the light-emitting elements are provided in each pixel.

When all the transistors in pixels have the same polarity, it is possible to reduce the number of manufacturing steps of the transistors. Patent Document 1 discloses a display device in which transistors included in pixels are all n-channel transistors.

REFERENCE

Patent Document

[Patent Document 1] Japanese Published Patent Application No. 2003-195810

SUMMARY OF THE INVENTION

Now, as an n-channel transistor included in a pixel, a transistor in which a channel is formed in an oxide semiconductor layer has been expected. This is because the transistor has higher field-effect mobility than a transistor in which a channel is formed in an amorphous silicon layer and a display device provided with the transistor in each pixel can be made larger.

Further, the transistor in which a channel is formed in an oxide semiconductor layer has characteristics of extremely small off-state current. This means that the transistor is preferable as a switch. However, defects may occur when supply of power supply voltage to a display device including the transistor is stopped. Specifically, charge is kept held in a particular node of a pixel even in the case where the supply of power supply voltage is stopped. Thus, display defects might occur in the case where, for example, the supply of power supply voltage to the display device is resumed.

In view of the above problem, it is an object of one embodiment of the present invention to suppress display defects in a display device.

One embodiment of the present invention is a display device including a plurality of pixels arranged in matrix. Each pixel includes a light-emitting element, a driving transistor which supplies current corresponding to voltage between a gate and a source to the light-emitting element, a first transistor which selects whether to supply a desired potential to the gate of the driving transistor, and a second transistor which selects whether to electrically connect the gate and the source of the driving transistor. The first transistor and the second transistor are transistors in each of which a channel is formed in an oxide semiconductor layer.

In the case where current output from the source of the driving transistor is supplied to the light-emitting element, the pixel is preferably provided with a means that controls current supplied to the light-emitting element without dependence on the threshold voltage of the driving transistor. For example, the pixel is preferably provided with the means in the case where an n-channel transistor whose drain is electrically connected to a wiring for supplying a high power supply potential is used as the driving transistor.

In the display device of one embodiment of the present invention, it is possible to select whether to electrically connect the gate and the source of the driving transistor provided in each pixel. Further, electrical connection between the gate of the driving transistor and another node is controlled by the transistors in each of which a channel is formed in an oxide semiconductor layer. Accordingly, charge stored in the node electrically connected to the gate of the driving transistor can be arbitrarily retained or released. For example, the driving transistor can be turned off by electrical connection between the gate and the source of the driving transistor before supply of power supply voltage to the display device is stopped, or after the supply of power supply voltage is resumed and before current is supplied to the light-emitting element. Accordingly, display defects that may occur when the supply of power supply voltage to the display device is resumed can be suppressed.

DETAILED DESCRIPTION OF THE INVENTION

Embodiments of the present invention will be described below in detail. Note that the present invention is not limited to the description below, and a variety of changes can be made without departing from the spirit and scope of the present invention. Therefore, the invention should not be construed as being limited to the description below.

Note that in this specification, being "electrically connected" corresponds to a state in which current, voltage, or a potential can be supplied or transmitted. Therefore, the state of being "electrically connected" does not necessarily mean the state of direct connection, but includes in its category, the state of indirect connection through an element such as a wiring, a conductive film, a resistor, a diode, or a transistor so that current, voltage, or a potential can be supplied or transmitted.

In addition, even when different components are connected to each other in a circuit diagram, there is actually a case where one conductive film has functions of a plurality of components such as a case where part of a wiring serves as an electrode. The term "connection" also means such a case where one conductive film has functions of a plurality of components.

Embodiment 1

Figure 1:
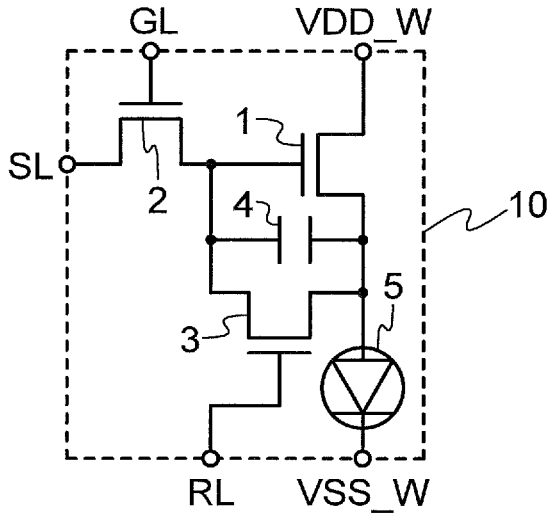
FIG. 1 is a circuit diagram illustrating a configuration example of a pixel.

FIG. 1 is a circuit diagram illustrating a configuration example of a pixel 10 included in a display device of this embodiment. The pixel 10 in FIG. 1 includes transistors 1 to 3, a capacitor 4, and a light-emitting element 5. Note that the transistors 1 to 3 are n-channel transistors in each of which a channel is formed in an oxide semiconductor layer.

The transistor 1 has a function of supplying current corresponding to voltage between a gate and a source of the transistor 1 to the light-emitting element 5. The transistor 2 has a function of selecting whether to electrically connect a wiring SL and the gate of the transistor 1. The transistor 3 has a function of selecting whether to electrically connect the gate and the source of the transistor 1. The capacitor 4 has a function of holding voltage between the gate and the source of the transistor 1. The light-emitting element 5 has a function of emitting light at a luminance corresponding to current supplied from the transistor 1.

Further, a drain of the transistor 1 is electrically connected to a wiring VDD_W for supplying a high power supply potential (VDD). Further, a gate of the transistor 2 is electrically connected to a wiring GL for supplying a selection signal or a non-selection signal. A gate of the transistor 3 is electrically connected to a wiring RL for supplying a reset signal. A cathode of the light-emitting element 5 is electrically connected to a wiring VSS_W for supplying a low power supply potential (VSS).

Next, operation of the pixel 10 in FIG. 1 will be described.

In the pixel 10, whether a potential of the wiring SL is supplied to the gate of the transistor 1 is selected by switching of the transistor 2. Specifically, when a selection signal is supplied to the gate of the transistor 2, the potential of the wiring SL is supplied to the gate of the transistor 1, and when a non-selection signal is supplied to the gate of the transistor 2, the potential of the wiring SL is not supplied to the gate of the transistor 1. The voltage between the gate and the source of the transistor 1 is changed in accordance with the potential of the gate of the transistor 1. Accordingly, current corresponding to the potential supplied to the gate of the transistor 1 is supplied to the light-emitting element 5. That is, emission luminance of the light-emitting element 5 is controlled in accordance with the potential. In the display device of this embodiment, desired display is performed by the control of emission luminance of each of the light-emitting elements provided in a plurality of pixels in accordance with the potential.

Further, in the pixel 10, whether the gate and the source of the transistor 1 are electrically connected is selected by switching of the transistor 3. For example, the transistor 3 is turned on for a certain period just before supply of power supply voltage to the display device is stopped, and the transistor 3 is turned off for the other periods. Accordingly, the charge accumulated in a node electrically connected to the gate of the transistor 1 can be discharged just before the supply of power supply voltage to the display device is stopped. That is, the transistor 1 can be surely turned off. Thus, in the display device of this embodiment, current is not supplied to the light-emitting element 5 when the supply of power supply voltage is resumed, and display defects can be suppressed.

The same effect can be obtained by turning on the transistor 3 for a certain period after the supply of power supply voltage is resumed and before the current could be supplied to the light-emitting element 5 (before a high power supply potential (VDD) is supplied to the wiring VDD_W and a low power supply potential (VSS) is supplied to the VSS_W).

Embodiment 2

Figure 2A:
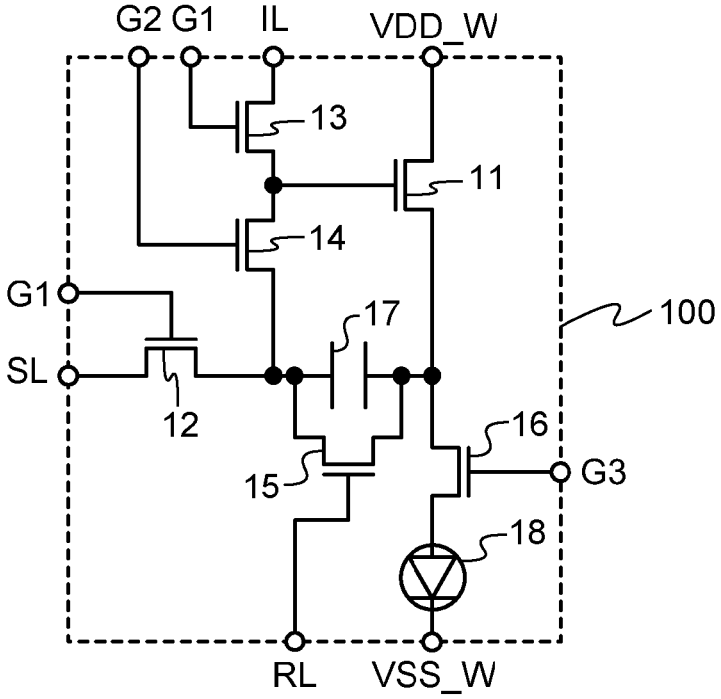
FIGS. 2A and 2B are circuit diagrams each illustrating a configuration example of a pixel.
Figure 2B:
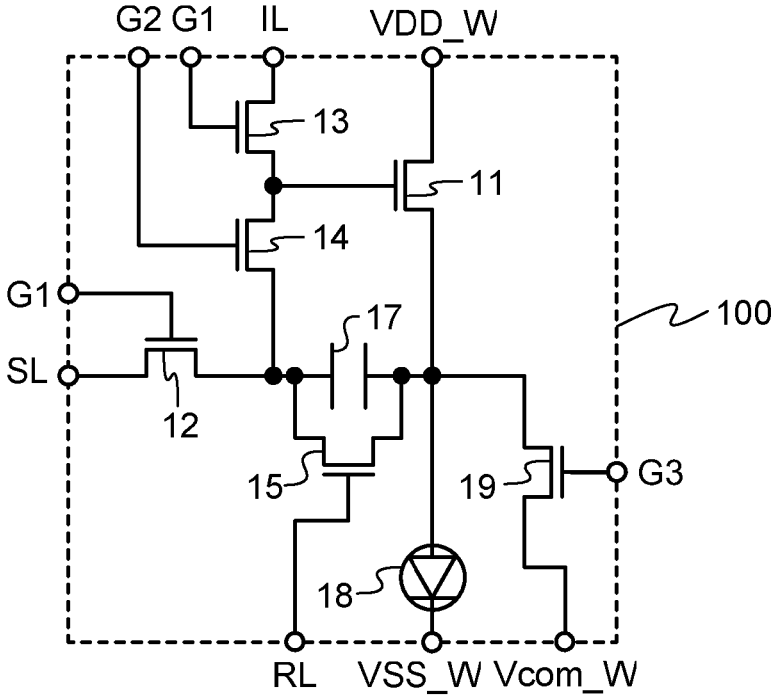

FIGS. 2A and 2B are circuit diagrams each illustrating a configuration example of a pixel 100 that is different from the pixel 10 described in Embodiment 1.

Configuration Example 1 of Pixel

The pixel 100 illustrated in FIG. 2A includes transistors 11 to 16, a capacitor 17, and a light-emitting element 18. Note that the transistors 11 to 16 are n-channel transistors in each of which a channel is formed in an oxide semiconductor layer.

The transistor 12 has a function of selecting whether to electrically connect a wiring SL and one of electrodes of the capacitor 17. The transistor 13 has a function of selecting whether to electrically connect a wiring IL and a gate of the transistor 11. The transistor 14 has a function of selecting whether to electrically connect the one electrode of the capacitor 17 and the gate of the transistor 11. The transistor 15 has a function of selecting whether to electrically connect the one electrode and the other electrode of the capacitor 17. The transistor 16 has a function of selecting whether to electrically connect a source of the transistor 11 and an anode of the light-emitting element 18.

A drain of the transistor 11 is electrically connected to a wiring VDD_W. A gate of the transistor 12 and a gate of the transistor 13 are electrically connected to a wiring G1 for supplying a selection signal or a non-selection signal. A gate of the transistor 14 is electrically connected to a wiring G2 for supplying a selection signal or a non-selection signal. A gate of the transistor 15 is electrically connected to a wiring RL for supplying a reset signal. A gate of the transistor 16 is electrically connected to a wiring G3 for supplying a selection signal or a non-selection signal. A cathode of the light-emitting element 18 is electrically connected to a wiring VSS_W.

Configuration Example 2 of Pixel

The pixel 100 illustrated in FIG. 2B includes transistors 11 to 15, a transistor 19, a capacitor 17, and a light-emitting element 18. Note that the transistors 11 to 15 and the transistor 19 are n-channel transistors in each of which a channel is formed in an oxide semiconductor layer.

The transistors 12 to 15 in the pixel 100 illustrated in FIG. 2B have functions similar to those of the transistors 12 to 15 in the pixel 100 illustrated in FIG. 2A. The transistor 19 in the pixel 100 illustrated in FIG. 2B has a function of selecting whether to electrically connect a source of the transistor 11 and a wiring Vcom_W for supplying a common potential (Vcom). Note that the common potential (Vcom) is lower than the sum of a low power supply potential (VSS) and a forward voltage drop of the light-emitting element 18. The low power supply potential (VSS) can be used as the common potential (Vcom), for example.

Operation Example 1 of Pixel

Next, operation of the pixel 100 illustrated in FIG. 2A will be described.

Figure 3:
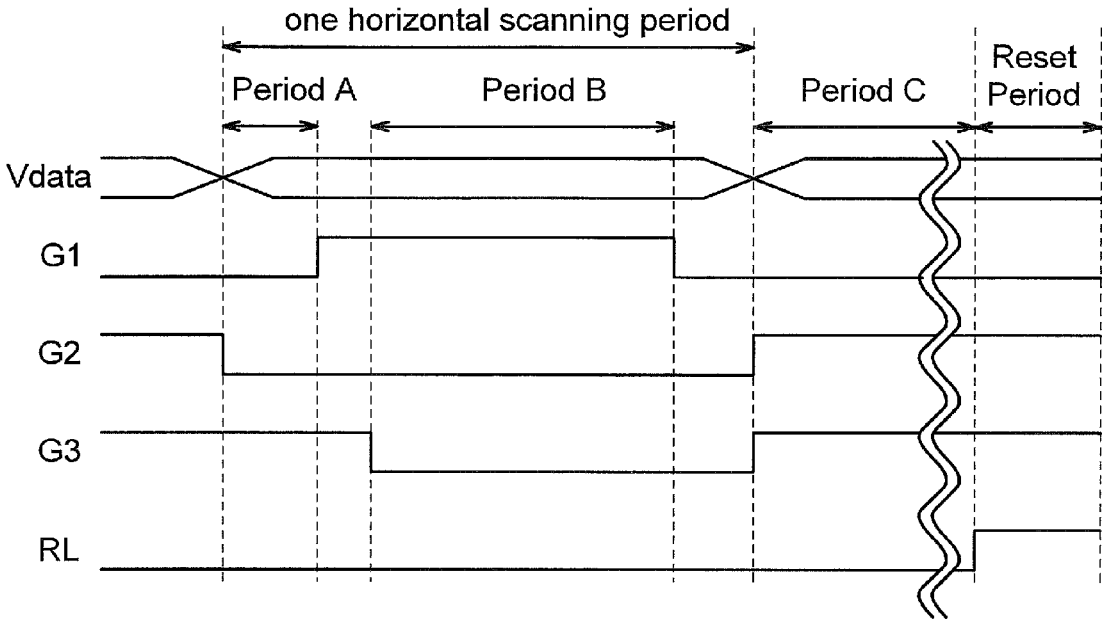
FIG. 3 is a diagram illustrating an example of a timing chart.

FIG. 3 is a timing chart illustrating potentials of the wirings G1 to G3, a potential supplied to the wiring RL, and a signal (Vdata) supplied to the wiring SL; the wirings G1 to G3, the wiring RL, and the wiring SL are connected to the pixel 100 in FIG. 2A. As illustrated in FIG. 3, the operation of the pixel 100 illustrated in FIG. 2A can be mainly divided into operation in a period A and operation in a period B which are included in one horizontal scanning period, operation in a period C in which an image is displayed, and operation in a reset period.

First, the operation in the period A is described. In the period A, a low-level potential is applied to the wiring G1, a low-level potential is applied to the wiring G2, a high-level potential is applied to the wiring G3, and a low-level potential is applied to the wiring RL. Thus, the transistor 16 is turned on, and the transistors 12 to 15 are turned off.

Figure 4A:
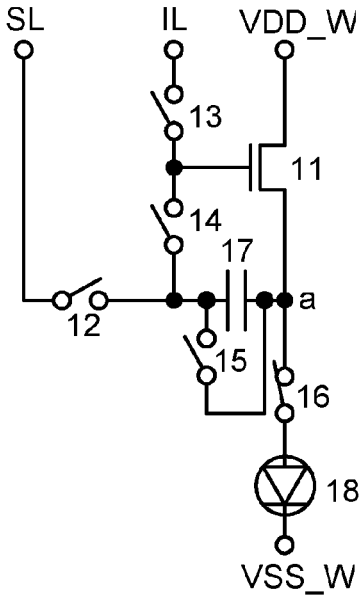
FIGS. 4A to 4D are diagrams each illustrating operation of a pixel.

FIG. 4A illustrates the operation of the pixel 100 in the period A. In FIG. 4A, the transistors 12 to 16 are represented as switches (the same applies to FIGS. 4B to 4D). In the period A, by the above operation, a node (illustrated as a node a in FIGS. 4A to 4D) electrically connected to the source of the transistor 11 has a potential which is the sum of the low power supply potential (VSS) and the forward voltage drop of the light-emitting element 18.

Next, the operation in the period B is described. In the period B, a high-level potential is applied to the wiring G1, a low-level potential is applied to the wiring G2, a low-level potential is applied to the wiring G3, and a low-level potential is applied to the wiring RL. Thus, the transistors 12 and 13 are turned on, and the transistors 14 to 16 are turned off.

In transition from the period A to the period B, it is preferable that the potential applied to the wiring G3 be switched from a high-level potential to a low-level potential after the potential applied to the wiring G1 is switched from a low-level potential to a high-level potential, in which case the potential of the node a can be prevented from being changed.

A potential (V0) is applied to the wiring IL, and a potential (Vdata) of an image signal is applied to the wiring SL. Note that the potential (V0) is preferably higher than the potential which is the sum of the low power supply potential (VSS), the threshold voltage (Vth) of the transistor 11, and the forward voltage drop of the light-emitting element 18.

Figure 4B:
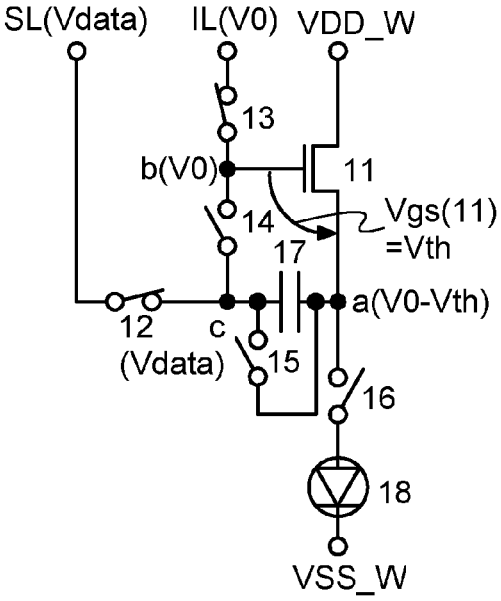

FIG. 4B illustrates the operation of the pixel 100 in the period B. In the period B, by the above operation, the potential (V0) is applied to a node (illustrated as a node b in FIGS. 4B to 4D) electrically connected to the gate of the transistor 11; thus the transistor 11 is turned on. Thus, the potential of the node a increases to a potential (V0−Vth). In other words, the transistor 11 is turned off at the time when a voltage (Vgs (11)) between the gate and the source of the transistor 11 becomes the threshold voltage (Vth). Further, a potential (Vdata) is applied to a node (illustrated as a node c in FIGS. 4B to 4D) electrically connected to the one electrode of the capacitor 17.

Next, the operation in the period C is described. In the period C, a low-level potential is applied to the wiring G1, a high-level potential is applied to the wiring G2, a high-level potential is applied to the wiring G3, and a low-level potential is applied to the wiring RL. Thus, the transistors 14 and 16 are turned on, and the transistors 12, 13, and 15 are turned off.

In transition from the period B to the period C, it is preferable that the potential applied to the wirings G2 and G3 be switched from a low-level potential to a high-level potential after the potential applied to the wiring G1 is switched from a high-level potential to a low-level potential, in which case the potential of the node a can be prevented from being changed.

Figure 4C:
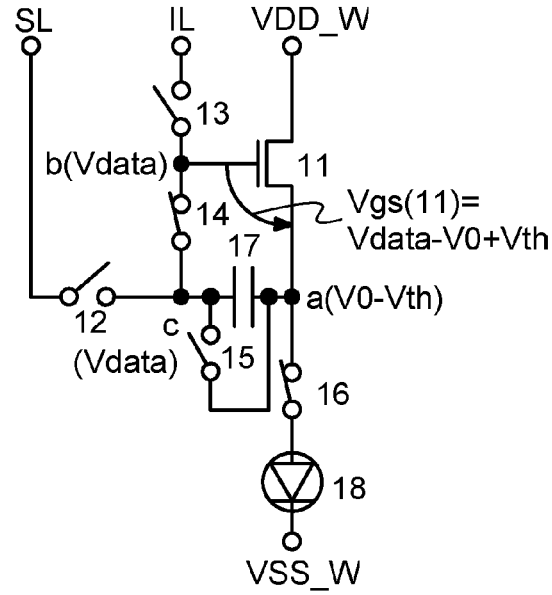

FIG. 4C illustrates the operation of the pixel 100 in the period C. In the period C, the potential of the gate of the transistor 11 rises to (Vdata) since the potential (Vdata) is applied to the node b by the above operation. Thus, the voltage (Vgs (11)) between the gate and the source of the transistor 11 becomes a potential difference (Vdata−V0+Vth) between the potential (Vdata) and the potential of the node a (V0−Vth). As described above, in the case where the voltage between the gate and the source of the transistor 11 is a value including the threshold voltage of the transistor 11, current supplied to the light-emitting element 18 can be controlled without dependence on variation in the threshold voltage (Vth) of the transistor 11. Further, even in the case where the transistor 11 deteriorates and the threshold voltage (Vth) changes, the current supplied to the light-emitting element 18 can be controlled without dependence on the change. Therefore, display unevenness can be reduced, and high-quality images can be displayed.

Next, the operation in the reset period is described. In the reset period, a low-level potential is applied to the wiring G1, a high-level potential is applied to the wiring G2, a high-level potential is applied to the wiring G3, and a high-level potential is applied to the wiring RL. Thus, the transistors 14 to 16 are turned on, and the transistors 12 and 13 are turned off.

Figure 4D:
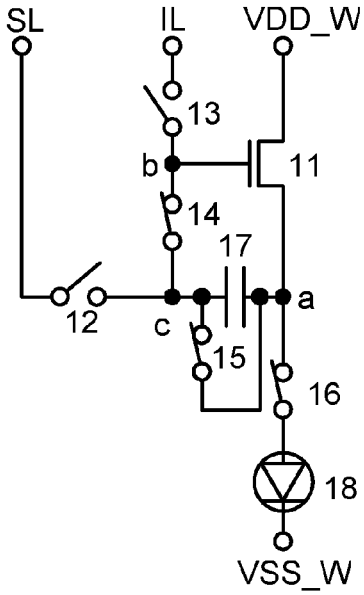

FIG. 4D illustrates the operation of the pixel 100 in the reset period. In the reset period, the gate and the source of the transistor 11 are electrically connected to each other by the above operation. Accordingly, the charge accumulated in the gate of the transistor 11 and the one electrode of the capacitor 17 is discharged through the transistors 14 to 16 and the light-emitting element 18. As a result, the transistor 11 is turned off. As described above, the supply of the power-supply voltage is stopped after surely turning off the transistor 11, so that current is not supplied to the light-emitting element 18 when the supply of the power-supply voltage is resumed, and display defects can be suppressed.

Note that in the case where the reset period is provided after the supply of the power supply voltage is resumed and before current could be supplied to the light-emitting element 18, the same effect can be obtained.

Operation Example 2 of Pixel

Next, the operation of the pixel 100 illustrated in FIG. 2B will be described.

Figure 5:
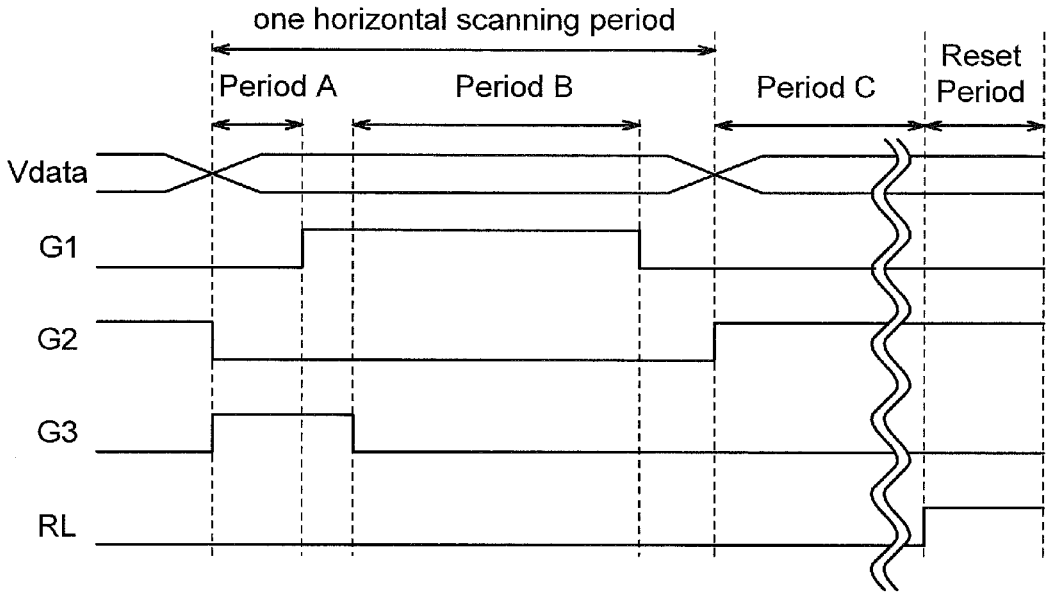
FIG. 5 is a diagram illustrating an example of a timing chart.

FIG. 5 is a timing chart illustrating potentials of the wirings G1 to G3, a potential supplied to the wiring RL, and a signal (Vdata) supplied to the wiring SL; the wirings G1 to G3, the wiring RL, and the wiring SL are connected to the pixel 100 in FIG. 2B. As illustrated in FIG. 5, the operation of the pixel 100 illustrated in FIG. 2B can be mainly divided into operation in a period A and operation in a period B which are included in one horizontal scanning period, operation in a period C in which an image is displayed, and operation in a reset period.

First, the operation in the period A is described. In the period A, a low-level potential is applied to the wiring G1, a low-level potential is applied to the wiring G2, a high-level potential is applied to the wiring G3, and a low-level potential is applied to the wiring RL. Thus, the transistor 19 is turned on, and the transistors 12 to 15 are turned off.

Figure 6A:
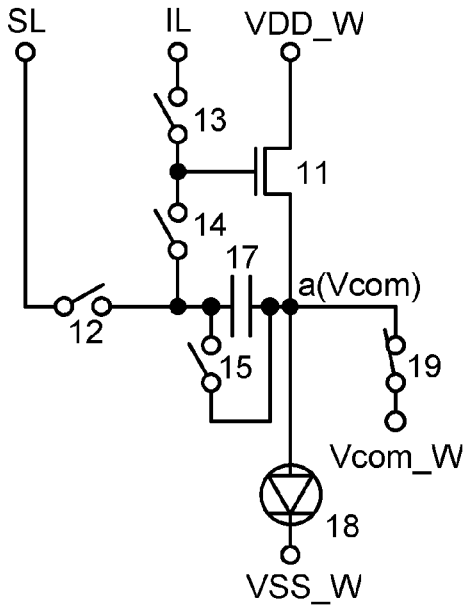
FIGS. 6A to 6D are diagrams each illustrating operation of a pixel.

FIG. 6A illustrates the operation of the pixel 100 in the period A. In FIG. 6A, the transistors 12 to 15, and the transistor 19 are represented as switches (the same applies to FIGS. 6B to 6D). In the period A, by the above operation, the potential of a node (illustrated as a node a in FIGS. 6A to 6D) electrically connected to the source of the transistor 11 becomes a common potential (Vcom).

Next, the operation in the period B is described. In the period B, a high-level potential is applied to the wiring G1, a low-level potential is applied to the wiring G2, a low-level potential is applied to the wiring G3, and a low-level potential is applied to the wiring RL. Thus, the transistors 12 and 13 are turned on, and the transistors 14, 15, and 19 are turned off.

In transition from the period A to the period B, it is preferable that the potential applied to the wiring G3 be switched from a high-level potential to a low-level potential after the potential applied to the wiring G1 is switched from a low-level potential to a high-level potential, in which case the potential of the node a can be prevented from being changed.

The potential (V0) is applied to the wiring IL, and the potential (Vdata) of an image signal is applied to the wiring SL.

Figure 6B:
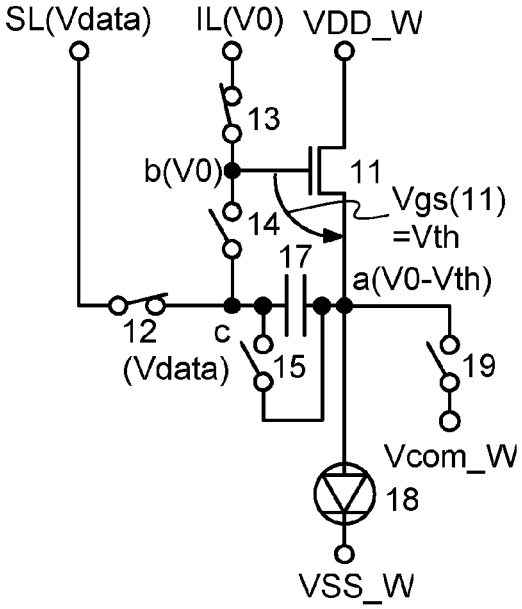

FIG. 6B illustrates the operation of the pixel 100 in the period B. Note that in the period B, the pixel 100 in FIG. 2B operates in the same way as the pixel 100 in FIG. 2A; thus, the above description is referred to here.

Next, the operation in the period C is described. In the period C, a low-level potential is applied to the wiring G1, a high-level potential is applied to the wiring G2, a low-level potential is applied to the wiring G3, and a low-level potential is applied to the wiring RL. Thus, the transistor 14 is turned on, and the transistors 12, 13, 15, and 19 are turned off.

In transition from the period B to the period C, it is preferable that the potential applied to the wiring G2 be switched from a low-level potential to a high-level potential after the potential applied to the wiring G1 is switched from a high-level potential to a low-level potential, in which case the potential of the node a can be prevented from being changed.

Figure 6C:
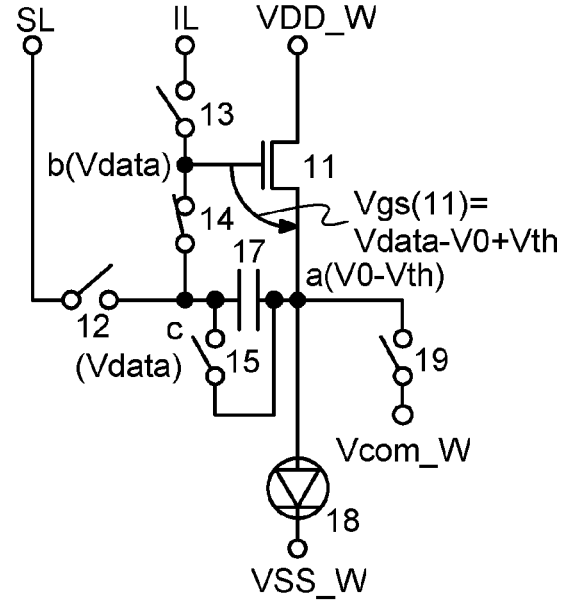

FIG. 6C illustrates the operation of the pixel 100 in the period C. Note that the pixel 100 in FIG. 2B operates in the same way as the pixel 100 in FIG. 2A; thus, the above description is referred to here.

Next, the operation in the reset period is described. In the reset period, a low-level potential is applied to the wiring G1, a high-level potential is applied to the wiring G2, a low-level potential is applied to the wiring G3, and a high-level potential is applied to the wiring RL. Thus, the transistors 14 and 15 are turned on, and the transistors 12, 13, and 19 are turned off.

Figure 6D:
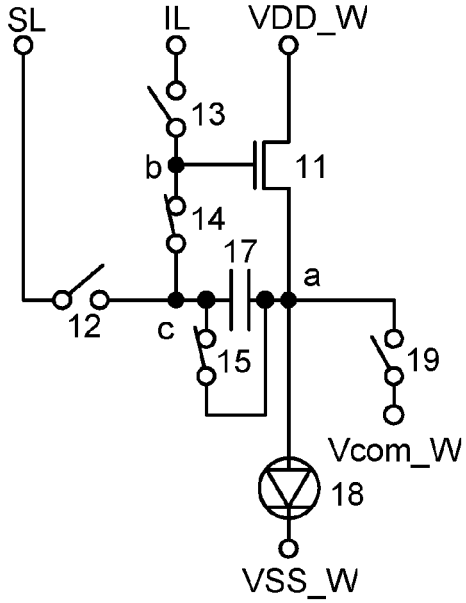

FIG. 6D illustrates the operation of the pixel 100 in the reset period. In the reset period, the gate and the source of the transistor 11 are electrically connected to each other by the above operation. Accordingly, the charge accumulated in the gate of the transistor 11 and the one electrode of the capacitor 17 is discharged through the transistors 14 and 15 and the light-emitting element 18. As a result, the transistor 11 is turned off. As described above, the supply of the power supply voltage is stopped after surely turning off the transistor 11, so that current is not supplied to the light-emitting element 18 when the supply of the power-supply voltage is resumed, and display defects can be suppressed.

Note that in the case where the reset period is provided after the supply of the power supply voltage is resumed and before current could be supplied to the light-emitting element 18, the same effect can be obtained.

Embodiment 3

Figure 7:
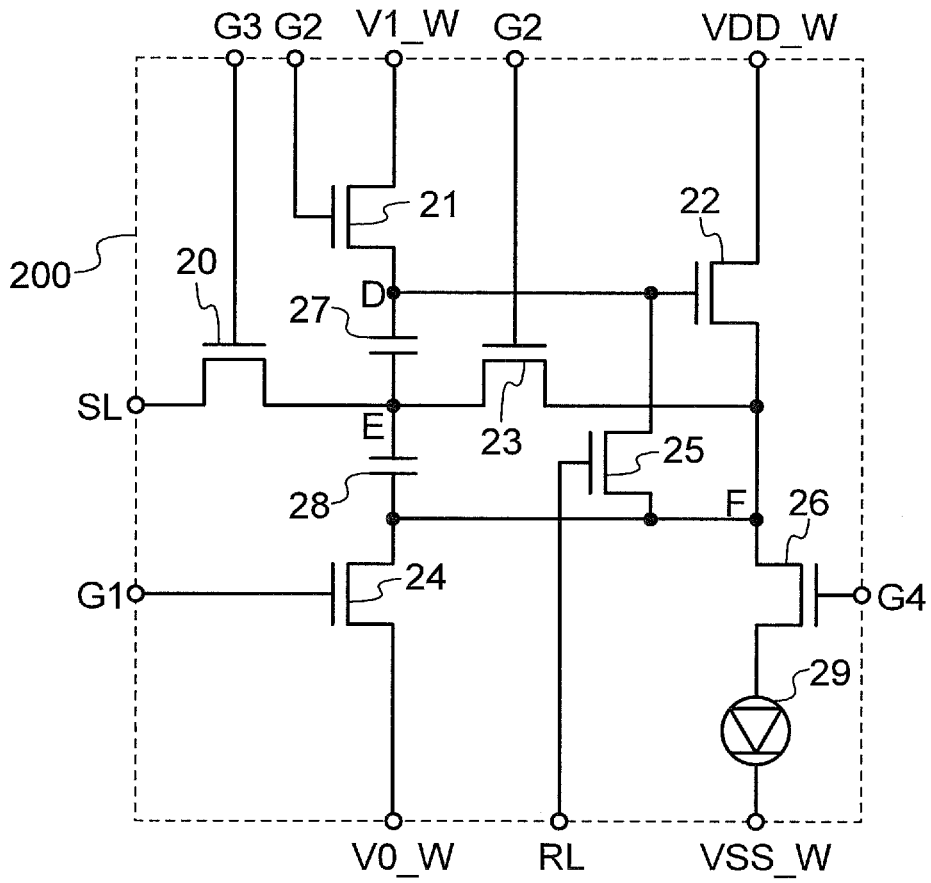
FIG. 7 is a circuit diagram illustrating a configuration example of a pixel.

FIG. 7 is a circuit diagram illustrating a configuration example of a pixel 200 that is different from the pixels described in the above Embodiments. The pixel 200 illustrated in FIG. 7 includes transistors 20 to 26, capacitors 27 and 28, and a light-emitting element 29. Note that the transistors 20 to 26 are n-channel transistors in each of which a channel is formed in an oxide semiconductor layer.

One of a source and a drain of the transistor 20 is electrically connected to a wiring SL, and a gate of the transistor 20 is electrically connected to a wiring G3.

One of a source and a drain of the transistor 21 is electrically connected to a wiring V1_W for supplying a potential (V1), and a gate of the transistor 21 is electrically connected to a wiring G2. Here, assume that the potential V1 is lower than a high power supply potential (VDD) and higher than a low power supply potential (VSS).

A drain of the transistor 22 is electrically connected to a wiring VDD_W for supplying the high power supply potential (VDD), and a gate of the transistor 22 is electrically connected to the other of the source and the drain of the transistor 21.

One of a source and a drain of the transistor 23 is electrically connected to the other of the source and the drain of the transistor 20; the other of the source and the drain of the transistor 23 is electrically connected to a source of the transistor 22; and a gate of the transistor 23 is electrically connected to the wiring G2.

One of a source and a drain of the transistor 24 is electrically connected to a wiring V0_W for supplying a potential V0; the other of the source and the drain of the transistor 24 is electrically connected to the source of the transistor 22 and the other of the source and the drain of the transistor 23; and a gate of the transistor 24 is electrically connected to the wiring G1. Here, assume that the potential (V0) is lower than the potential (V1) and higher than the low power supply potential (VSS).

One of a source and a drain of the transistor 25 is electrically connected to the other of the source and the drain of the transistor 21 and the gate of the transistor 22; the other of the source and the drain of the transistor 25 is electrically connected to the source of the transistor 22, the other of the source and the drain of the transistor 23, and the other of the source and the drain of the transistor 24; and a gate of the transistor 25 is electrically connected to a wiring RL.

One of a source and a drain of the transistor 26 is electrically connected to the source of the transistor 22, the other of the source and the drain of the transistor 23, the other of the source and the drain of the transistor 24, and the other of the source and the drain of the transistor 25; and a gate of the transistor 26 is electrically connected to a wiring G4.

One electrode of the capacitor 27 is electrically connected to the other of the source and the drain of the transistor 21, the gate of the transistor 22, and the one of the source and the drain of the transistor 25; and the other electrode of the capacitor 27 is electrically connected to the other of the source and the drain of the transistor 20 and the one of the source and the drain of the transistor 23.

One electrode of the capacitor 28 is electrically connected to the other of the source and the drain of the transistor 20, the one of the source and the drain of the transistor 23, and the other electrode of the capacitor 27; and the other electrode of the capacitor 28 is electrically connected to the source of the transistor 22, the other of the source and the drain of the transistor 23, the other of the source and the drain of the transistor 24, the other of the source and the drain of the transistor 25, and the one of the source and the drain of the transistor 26.

An anode of the light-emitting element 29 is electrically connected to the other of the source and the drain of the transistor 26; a cathode of the light-emitting element 29 is electrically connected to a wiring (VSS_W) for supplying the low power supply potential (VSS).

Hereinafter, a node where the other of the source and the drain of the transistor 21, the gate of the transistor 22, the one of the source and the drain of the transistor 25, and the one electrode of the capacitor 27 are electrically connected is referred to as a node D. A node where the other of the source and the drain of the transistor 20, the one of the source and the drain of the transistor 23, the other electrode of the capacitor 27, and the one electrode of the capacitor 28 are electrically connected is referred to as a node E. A node where the source of the transistor 22, the other of the source and the drain of the transistor 23, the other of the source and the drain of the transistor 24, the other of the source and the drain of the transistor 25, the one of the source and the drain of the transistor 26, and the other electrode of the capacitor 28 are electrically connected is referred to as a node F.

Operation Example of Pixel

Figure 8:
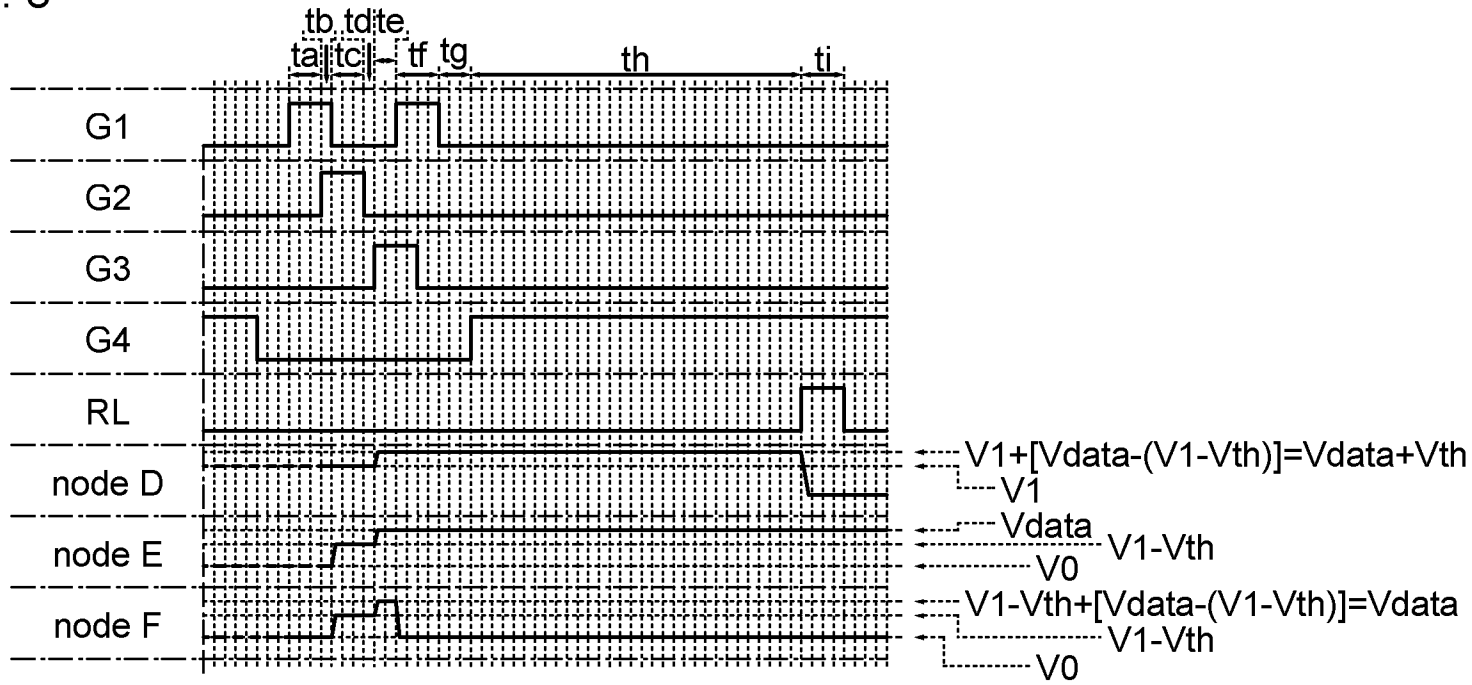
FIG. 8 is a diagram illustrating an example of a timing chart.

An operation example of the above pixel will be described with reference to FIG. 8. Specifically, FIG. 8 illustrates changes of potentials of the wirings G1 to G4, the wiring RL, and the nodes D, E, and F.

In a period ta, a high-level potential is applied to the wiring G1, low-level potentials are applied to the wirings G2 to G4, and a low-level potential is applied to the wiring RL. Thus, the transistor 24 is turned on, and the transistors 20, 21, 23, 25, and 26 are turned off.

In a period tb, a high-level potential is applied to the wiring G2. Thus, the transistors 21 and 23 are turned on. As a result, the potentials of the node D and the node E become (V1) and (V0), respectively. In response to the change of the potential of the node D to the potential (V1), the transistor 22 is turned on.

In a period tc, a low-level potential is applied to the wiring G1. Thus, the transistor 24 is turned off. Here, the transistor 22 remains on until the voltage between the gate and the source becomes lower than or equal to the threshold voltage. In other words, the transistor 22 remains on until the potential of the node F (the source of the transistor 22) becomes lower than the potential (potential (V1)) of the node D by the threshold voltage (Vth) of the transistor 22. As a result, the potential of the node F becomes a potential (V1−Vth). Note that in the period tc, the potential of the node N1 also rises to the potential (V1−Vth).

In a period td, a low-level potential is applied to the wiring G2. Accordingly, the transistors 21 and 23 are tuned off.

In a period te, a high-level potential is applied to the wiring G3. Accordingly, the transistor 20 is turned on. Note that in the period te, a potential (Vdata) of an image signal is supplied to the wiring SL. As a result, the potential of the node E becomes the potential (Vdata). In addition, the potentials of the nodes D and F are also changed owing to the potential of the node E. Specifically, the potential of the node D in a floating state is raised or lowered by the amount of change in potential of the node E (the difference between the potential (Vdata) of the image signal and the potential lower than the potential (V1) by the threshold voltage (Vth) of the transistor 22 owing to the capacitive coupling between the node D and the node E through the capacitor 27 (the potential of the node D becomes V1+[Vdata−(V1−Vth)]=Vdata+Vth); and the potential of the node F in a floating state is raised or lowered by the amount of change in potential of the node E owing to the capacitive coupling between the node E and the node F through the capacitor 28 (the potential of the node F becomes V1−Vth+[Vdata−(V1−Vth)]=Vdata).

In a period tf, a high-level potential is applied to the wiring G1. Thus, the transistor 24 is turned on. As a result, the potential of the node F becomes (V0).

In a period tg, a low-level potential is applied to the wiring G1. Thus, the transistor 24 is tuned off.

In a period th, a high-level potential is applied to the wiring G4. Thus, the transistor 26 is turned on. As a result, a current corresponding to the voltage between the gate and the source of the transistor 22 is supplied to the light-emitting element 29. Here, the voltage corresponds to the difference between the potential (Vdata+Vth) of the node D and the potential of the node F. In this case, the current supplied to the light-emitting element 29 (the drain current in a saturated region of the transistor 22) is not dependent on the threshold voltage of the transistor 22.

In a period ti, a high-level potential is applied to the wiring RL. Thus the transistor 25 is turned on. As a result, the transistor 22 is turned off.

After the period ti, the supply of the power supply voltage to the display device is stopped. As described above, the supply of the power supply voltage is stopped after surely turning off the transistor 22, so that current is not supplied to the light-emitting element 29 when the supply of the power-supply voltage is resumed, and display defects can be suppressed.

Note that in the case where the period ti is provided after the supply of the power supply voltage is resumed and before current could be supplied to the light-emitting element 29, the same effect can be obtained.

Embodiment 4

In this embodiment, a structure example of a display device will be described. Specifically, a display device with a top emission structure is described as an example in this embodiment. Needless to say, the structure of the display device disclosed in this specification is not limited to the top emission structure, and can be a bottom emission structure or a dual emission structure. Note that the dual emission structure means a structure in which light from a light-emitting element is emitted from two sides of the display device.

Cross-Sectional Structure Example

Figure 9:
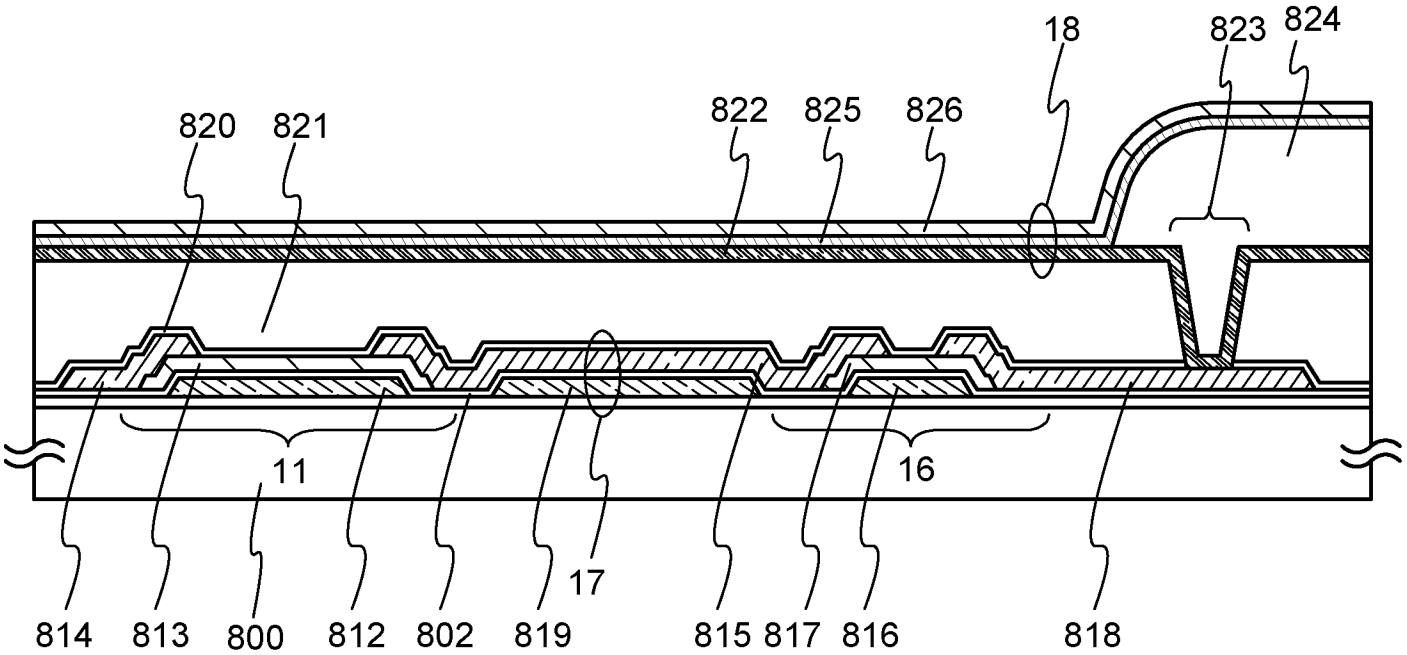
FIG. 9 is a cross-sectional view illustrating a structure example of a display device.

FIG. 9 is a cross-sectional view illustrating an example of the display device disclosed in this specification. Specifically, the display device in FIG. 9 is a cross-sectional view illustrating an example of the transistors 11 and 16, the capacitor 17, and the light-emitting element 18 which are shown in FIG. 2A.

The transistor 11 includes, over a substrate 800 having an insulating surface, a conductive film 812 functioning as a gate, a gate insulating film 802 over the conductive film 812, an oxide semiconductor layer 813 positioned over the gate insulating film 802 to overlap with the conductive film 812, and conductive films 814 and 815 that are positioned over the oxide semiconductor layer 813 and function as a source and a drain. Note that the conductive film 814 is the wiring VDD_W in FIG. 2A.

The transistor 16 includes, over the substrate 800 having an insulating surface, a conductive film 816 functioning as a gate, the gate insulating film 802 over the conductive film 816, an oxide semiconductor layer 817 positioned over the gate insulating film 802 to overlap with the conductive film 816, and the conductive film 815 and a conductive film 818 that are positioned over the oxide semiconductor layer 817 and function as a source and a drain. Note that the conductive film 816 is the wiring G3 in FIG. 2A.

The capacitor 17 includes, over the substrate 800 having an insulating surface, a conductive film 819, the gate insulating film 802 over the conductive film 819, and the conductive film 815 positioned over the gate insulating film 802 to overlap with the conductive film 819.

Insulating films 820 and 821 are formed over the conductive films 814, 815, and 818. In addition, a conductive film 822 functioning as the anode of the light-emitting element 18 is formed over the insulating film 821. The conductive film 822 is electrically connected to the conductive film 818 through a contact hole 823 that is formed in the insulating films 820 and 821.

In addition, an insulating film 824 having an opening where part of the conductive film 822 is exposed is provided over the insulating film 821. An EL layer 825 and a conductive film 826 functioning as the cathode of the light-emitting element 18 are stacked in this order over the part of the conductive film 822 and the insulating film 824. A region where the conductive film 822, the EL layer 825, and the conductive film 826 overlap one another corresponds to the light-emitting element 18.

Specific Example of Oxide Semiconductor Layers 813 and 817

(1) Material

A film containing at least indium can be used as each of the oxide semiconductor layers 813 and 817. In particular, a film containing indium and zinc is preferably used. In addition, as a stabilizer for reducing the variation in electric characteristics of a transistor, a film containing gallium in addition to indium and zinc is preferably used.

Alternatively, a film which contains, as a stabilizer, one or more of tin, hafnium, aluminum, zirconium, and lanthanoid such as lanthanum, cerium, praseodymium, neodymium, samarium, europium, gadolinium, terbium, dysprosium, holmium, erbium, thulium, ytterbium, or lutetium can be used as each of the oxide semiconductor layers 813 and 817.

As each of the oxide semiconductor layers 813 and 817, for example, a film of any of the following oxides can be used: indium oxide; a two-component metal oxide such as an In—Zn-based oxide, an In—Mg-based oxide, or an In—Ga-based oxide; a three-component metal oxide such as an In—Ga—Zn-based oxide, an In—Al—Zn-based oxide, an In—Sn—Zn-based oxide, an In—Hf—Zn-based oxide, an In—La—Zn-based oxide, an In—Ce—Zn-based oxide, an In—Pr—Zn-based oxide, an In—Nd—Zn-based oxide, an In—Sm—Zn-based oxide, an In—Eu—Zn-based oxide, an In—Gd—Zn-based oxide, an In—Tb—Zn-based oxide, an In—Dy—Zn-based oxide, an In—Ho—Zn-based oxide, an In—Er—Zn-based oxide, an In—Tm—Zn-based oxide, an In—Yb—Zn-based oxide, or an In—Lu—Zn-based oxide; and a four-component metal oxide such as an In—Sn—Ga—Zn-based oxide, an In—Hf—Ga—Zn-based oxide, an In—Al—Ga—Zn-based oxide, an In—Sn—Al—Zn-based oxide, an In—Sn—Hf—Zn-based oxide, or an In—Hf—Al—Zn-based oxide.

Note that here, for example, an "In—Ga—Zn-based oxide" means an oxide containing In, Ga, and Zn as its main component, in which there is no particular limitation on the ratio of In:Ga:Zn. The In—Ga—Zn-based oxide may contain a metal element other than the In, Ga, and Zn.

Nitrogen may be substituted for part of constituent oxygen of the oxide semiconductor layers 813 and 817.

(2) Crystal Structure

For each of the oxide semiconductor layers 813 and 817, a film having a single crystal state, a polycrystalline (also referred to as polycrystal) state, an amorphous state, or the like can be used. In addition, a CAAC-OS (c-axis aligned crystalline oxide semiconductor) film can be used as each of the oxide semiconductor layers 813 and 817. The CAAC-OS film is described in detail below.

The CAAC-OS film is not completely single crystal nor completely amorphous. The CAAC-OS film is an oxide semiconductor film with a crystal-amorphous mixed phase structure where a crystal region and an amorphous region are included in an amorphous phase. Note that in many cases, the crystal region fits inside a cube whose one side is less than 100 nm. In an observation image obtained with a transmission electron microscope (TEM), a boundary between the amorphous region and the crystal region in the CAAC-OS film is not clear. Thus, in the CAAC-OS film, a reduction in electron mobility, due to the grain boundary, is suppressed.

In each of crystal regions included in the CAAC-OS film, a c-axis is aligned in a direction parallel to a normal vector of a surface where the CAAC-OS film is formed or a normal vector of a surface of the CAAC-OS film, triangular or hexagonal atomic arrangement which is seen from the direction perpendicular to the a-b plane is formed, and metal atoms are arranged in a layered manner or metal atoms and oxygen atoms are arranged in a layered manner when seen from the direction perpendicular to the c-axis. Note that the directions of the a-axis and the b-axis of one crystal region may be different from those of another crystal region. In this specification, a simple term "perpendicular" includes a range from 85° to 95°. In addition, a simple term "parallel" includes a range from −5° to 5°.

In the CAAC-OS film, distribution of crystal regions is not necessarily uniform. For example, in the case where crystal growth occurs from the surface side of an oxide semiconductor film in a formation process of the CAAC-OS film, the proportion of crystal regions in the vicinity of a surface of the CAAC-OS film is higher than that in the vicinity of the surface where the CAAC-OS film is formed in some cases.

Since the c-axes of the crystal regions included in the CAAC-OS film are aligned in the direction parallel to a normal vector of a surface where the CAAC-OS film is formed or a normal vector of a surface of the CAAC-OS film, the directions of the c-axes may be different from each other depending on the shape of the CAAC-OS film (the cross-sectional shape of the surface where the CAAC-OS film is formed or the cross-sectional shape of the surface of the CAAC-OS film). Note that when the CAAC-OS film is formed, the direction of c-axis of the crystal region is the direction parallel to a normal vector of the surface where the CAAC-OS film is formed or a normal vector of the surface of the CAAC-OS film. The crystal region included in the CAAC-OS is formed by deposition or by performing treatment for crystallization such as heat treatment after deposition.

With the use of the CAAC-OS film in a transistor, change in electric characteristics of the transistor due to irradiation with visible light or ultraviolet light is small. Thus, the transistor has high reliability.

(3) Layer Structure

For the oxide semiconductor layers 813 and 817, not only a single-layer oxide semiconductor film but also a layer formed of a stack having plural kinds of oxide semiconductor films may be used. For example, a layer including at least two of an amorphous oxide semiconductor film, a polycrystalline oxide semiconductor film, and a CAAC-OS film can be used as each of the oxide semiconductor layers 813 and 817.

It is also possible to use a layer formed of a stack of oxide semiconductor films with different compositions as each of the oxide semiconductor layers 813 and 817. Specifically, a layer including a first oxide semiconductor film (also referred to as a lower layer) which has a surface in contact with the gate insulating film 802 and a second oxide semiconductor film (also referred to as an upper layer) which is in contact with the insulating film 820 and has a different composition from the first oxide semiconductor film can be used as each of the oxide semiconductor layers 813 and 817. Note that in this case, a region in which a channel is formed is largely included in the lower layer. This is because the lower layer is closer to the conductive films 812 and 816 functioning as a gate than the upper layer is.

For example, in the case where the lower layer and the upper layer both contain indium, gallium, and zinc, concentrations are preferably set such that the indium concentration in the lower layer is higher than that in the upper layer and the gallium concentration in the upper layer is higher than that in the lower layer, or/and such that the indium concentration in the lower layer is higher than the gallium concentration in the lower layer and the gallium concentration in the upper layer is higher than the indium concentration in the upper layer.

Thus, it is possible to improve mobility of a transistor including the oxide semiconductor layers 813 and 817 and suppress formation of a parasitic channel in the transistor. Specifically, the mobility of the transistor can be improved by an increase in the indium concentration in the lower layer. This is because, in an oxide semiconductor, the s orbitals of heavy metal mainly contribute to carrier transfer, and when the In content in the oxide semiconductor is increased, overlaps of the s orbitals are increased. Further, a high gallium concentration of the upper layer leads to prevention of release of oxygen, which can prevent formation of a parasitic channel in the upper layer. This is because, in Ga, the formation energy of oxygen vacancies is larger and thus oxygen vacancies are less likely to occur, than in In.

(3) Specific Example of Gate Insulating Film 802

An inorganic insulating film such as a silicon oxide film, a silicon nitride film, a silicon oxynitride film, a silicon nitride oxide film, an aluminum oxide film, an aluminum oxynitride film, a gallium oxide film, or the like can be used as the gate insulating film 802. A stack formed using these materials can also be used. The aluminum oxide film has a high shielding (blocking) effect of preventing penetration of both oxygen and impurities such as hydrogen and moisture. Thus, the use of the layer including an aluminum oxide film as the gate insulating film 802 makes it possible to prevent release of oxygen from the oxide semiconductor layers 813 and 817 and prevent the entry of an impurity such as hydrogen to the oxide semiconductor layers 813 and 817.

The gate insulating film 802 can be formed using a film including a hafnium oxide film, a yttrium oxide film, a hafnium silicate ($HfSi_xO_y$ (x>0, y>0)) film, a hafnium silicate film to which nitrogen is added, a hafnium aluminate ($HfAl_xO_y$ (x>0, y>0)) film, or a lanthanum oxide film (i.e., a film formed of what is called a high-k material), whereby gate leakage current can be reduced.

Specific Example of Conductive Films 812, 816, and 819

A film containing an element selected from aluminum, copper, titanium, tantalum, tungsten, molybdenum, chrome, neodymium, and scandium or a film of an alloy containing any of these elements as its component can be used for each of the conductive films 812, 816, and 819. Alternatively, a metal oxide film containing nitrogen, specifically, an In—Ga—Zn—O film containing nitrogen, an In—Sn—O film containing nitrogen, an In—Ga—O film containing nitrogen, an In—Zn—O film containing nitrogen, a Sn—O film containing nitrogen, an In—O film containing nitrogen, or a metal nitride (e.g., InN or SnN) film can be used for each of the conductive films 812, 816, and 819. Such a nitride film has a work function of 5 eV (electron volts) or higher, preferably 5.5 eV (electron volts) or higher, which enables the threshold voltage of the transistor to be positive when used as the gate, so that what is called a normally-off switching element can be achieved. A stack including these films can also be used.

Specific Example of Conductive Films 814, 815, and 818

A film containing an element selected from aluminum, copper, titanium, tantalum, tungsten, molybdenum, chromium, neodymium, and scandium; a film of an alloy containing any of these elements; a film of a nitride containing any of these elements; or the like can be used for the conductive films 814, 815, and 818. A stack including these films can also be used.

Specific Example of Insulating Film 820

For the insulating film 820, an inorganic insulating material such as a silicon oxide film, a silicon nitride film, a silicon oxynitride film, a silicon nitride oxide film, an aluminum oxide film, an aluminum oxynitride film, or a gallium oxide film can be used. A stack formed using these films can also be used. The aluminum oxide film has a high shielding (blocking) effect of preventing penetration of both oxygen and impurities such as hydrogen and moisture. Therefore, when the layer including an aluminum oxide film is used as the insulating film 820, it is possible to prevent release of oxygen from the oxide semiconductor layers 813 and 817 and entry of an impurity such as hydrogen to the oxide semiconductor layers 813 and 817.

Specific Example of Insulating Film 821

For the insulating film 821, an inorganic insulating material such as a silicon oxide film, a silicon nitride film, a silicon oxynitride film, a silicon nitride oxide film, an aluminum oxide film, an aluminum oxynitride film, or a gallium oxide film can be used. Alternatively, the insulating film 821 can be formed using an organic insulating material film such as polyimide or acrylic. A stack formed using these films can also be used.

Specific Example of Conductive Film 822

For the conductive film 822, a film containing an element selected from aluminum, copper, titanium, tantalum, tungsten, molybdenum, chromium, neodymium, and scandium; a film of an alloy containing any of these elements; a film of a nitride containing any of these elements; or the like can be used. A stack including these films can also be used. In particular, for the conductive film 822, a metal having high reflectance (e.g., aluminum or silver), or an alloy containing the metal is preferably used.

Specific Example of EL Layer 825

For the EL layer 825, a single layer or a stack including a light-emitting layer containing a light-emitting organic material can be used.

Specific Example of Conductive Film 826

For the conductive film 826, a light-transmitting conductive film such as indium oxide-tin oxide, indium oxide-tin oxide containing silicon or silicon oxide, indium oxide-zinc oxide, or indium oxide containing tungsten oxide and zinc oxide can be used.

Specific Example of Insulating Film 824

For the insulating film 824, an organic insulating material film such as polyimide or acrylic can be used.

Example 1

Figure 10:
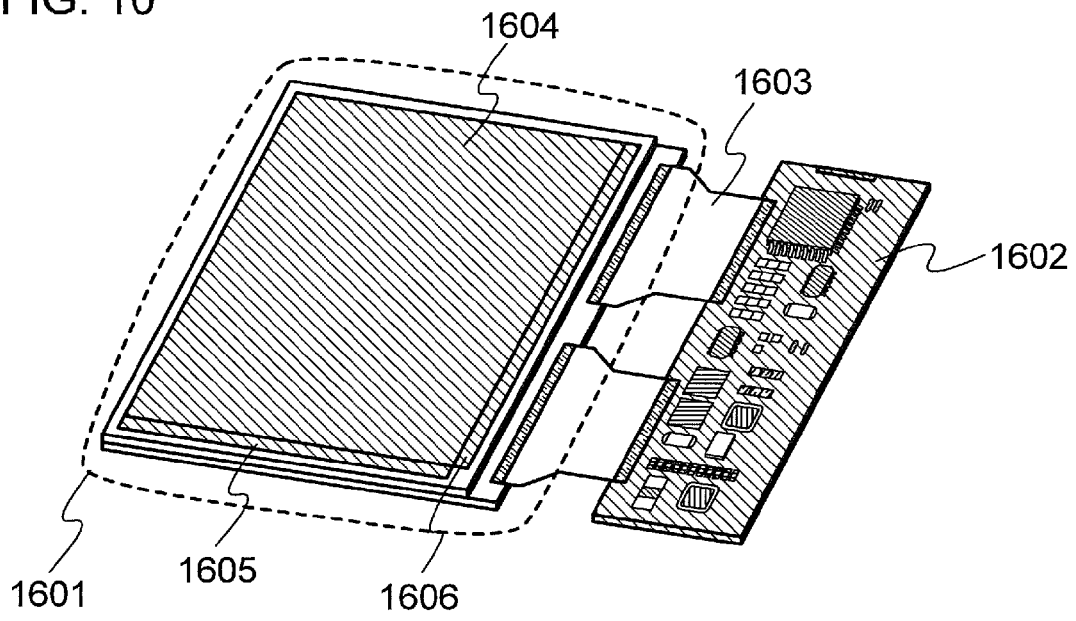
FIG. 10 is a perspective view illustrating an example of a display device.

FIG. 10 is a perspective view illustrating an example of a display device.

The display device illustrated in FIG. 10 includes a panel 1601, a circuit substrate 1602, and a connecting portion 1603. The panel 1601 includes a pixel portion 1604 including a plurality of pixels, a scan line driver circuit 1605 that selects pixels per row, and a signal line driver circuit 1606 that controls input of an image signal to the pixels in a selected row. Specifically, signals input to the wiring GL illustrated in FIG. 1, the wirings G1 to G3 illustrated in FIGS. 2A and 2B, and the wirings G1 to G4 illustrated in FIG. 7 are generated in the scan line driver circuit 1605.

Various signals and power supply potentials are input from the circuit board 1602 to the panel 1601 through the connecting portion 1603. For the connecting portion 1603, a flexible printed circuit (FPC) or the like can be used. In the case where a COF tape is used as the connecting portion 1603, part of the circuit in the circuit board 1602 or part of the scan line driver circuit 1605 or the signal line driver circuit 1606 included in the panel 1601 may be formed on a chip separately prepared, and the chip may be connected to a COF tape by a COF (chip on film) method.

Example 2

The display device according to one embodiment of the present invention can be applied to television receivers, displays for electronic calculator, image reproducing devices provided with recording media (typically devices which reproduce the content of recording media such as DVDs (digital versatile disc) and have displays for displaying the reproduced images). Other examples of electronic devices that can include the display device according to one embodiment of the present invention are mobile phones, game machines including portable game machines, personal digital assistants, e-book readers, cameras such as video cameras and digital still cameras, goggle-type displays (head mounted displays), navigation systems, audio reproducing devices (e.g., car audio systems and digital audio players), copiers, facsimiles, printers, multifunction printers, automated teller machines (ATM), and vending machines. Specific examples of such electronic devices are shown in FIGS. 11A to 11D.

Figure 11A:
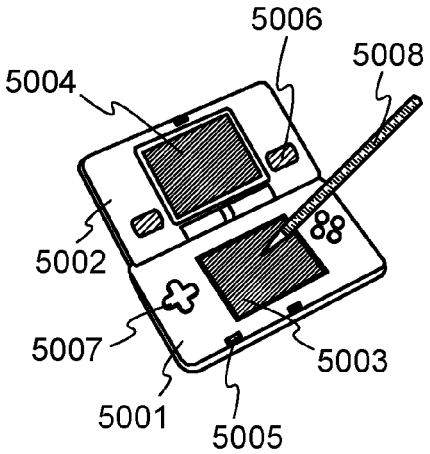
FIGS. 11A to 11D are diagrams illustrating specific examples of electronic devices.

FIG. 11A is a portable game machine, which includes a housing 5001, a housing 5002, a display portion 5003, a display portion 5004, a microphone 5005, speakers 5006, operation keys 5007, a stylus 5008, and the like. The display device according to one embodiment of the present invention can be used for the display portion 5003 and the display portion 5004. Although the portable game machine in FIG. 11A has the two display portions 5003 and 5004, the number of display portions included in the portable game machine is not limited to this.

Figure 11B:
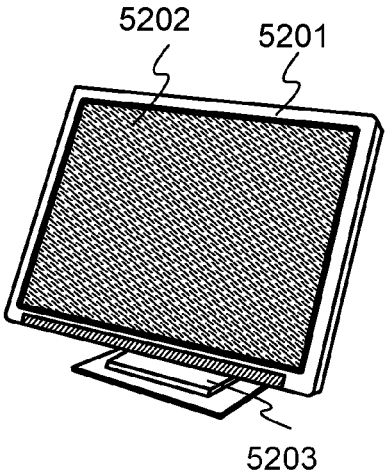

FIG. 11B is a television receiver, which includes a housing 5201, a display portion 5202, a support 5203, and the like. The display device according to one embodiment of the present invention can be used for the display portion 5202.

Figure 11C:
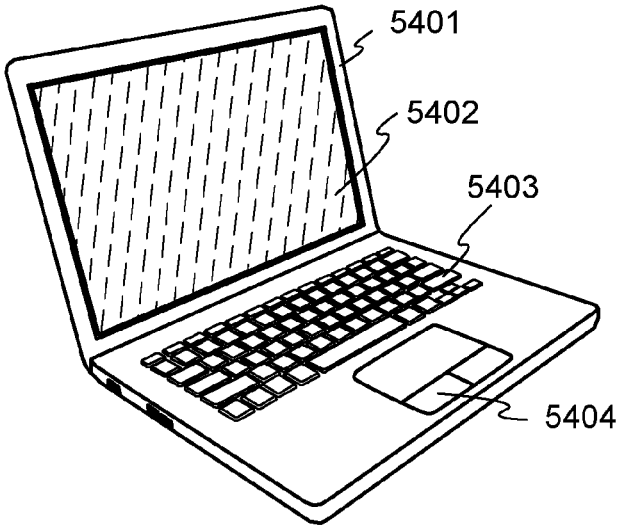

FIG. 11C is a laptop personal computer, which includes a housing 5401, a display portion 5402, a keyboard 5403, a pointing device 5404, and the like. The display device according to one embodiment of the present invention can be used for the display portion 5402.

Figure 11D:
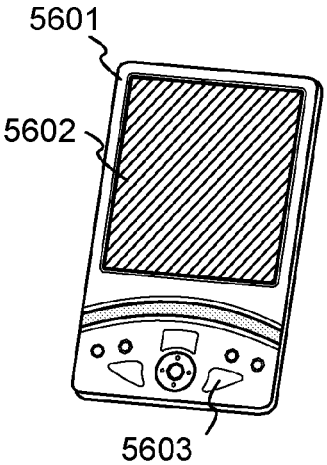

FIG. 11D illustrates a personal digital assistant, which includes a housing 5601, a display portion 5602, operation keys 5603, and the like. In the personal digital assistant in FIG. 11D, a modem may be incorporated in the housing 5601. The display device according to one embodiment of the present invention can be used for the display portion 5602.

This application is based on Japanese Patent Application serial No. 2012-056909 filed with Japan Patent Office on Mar. 14, 2012, the entire contents of which are hereby incorporated by reference.

What is claimed is:

1. A display device including a plurality of pixels, each pixel comprising:

a light-emitting element including a pair of electrodes; and a driving transistor, a first transistor, a second transistor and a third transistor, each including a gate, a source and a drain, wherein one of the source and the drain of the first transistor is electrically connected to the gate of the driving transistor, and one of the source and the drain of the third transistor, wherein the other of the source and the drain of the third transistor is electrically connected to one of the source and the drain of the second transistor, wherein one of the source and the drain of the driving transistor is electrically connected to one of the pair of electrodes of the light-emitting element, and the other of the source and the drain of the second transistor, wherein each channel of the first transistor, the second transistor and the third transistor includes an oxide semiconductor layer, and wherein a reset signal is configured to be input to the gate of the second transistor to turn on the second transistor during a reset period after a period in which an image is displayed.

2. The display device according to claim 1, wherein a channel of the driving transistor includes an oxide semiconductor layer.

3. The display device according to claim 1, wherein the display device is incorporated in one selected from the group consisting of a portable game machine, a television receiver, a laptop personal computer, and a personal digital assistant.

4. A display device including a plurality of pixels, each pixel comprising:

a light-emitting element including a pair of electrodes;

a driving transistor, a first transistor, a second transistor and a third transistor, each including a gate, a source and a drain; and a capacitor including a pair of electrodes, wherein one of the source and the drain of the first transistor is electrically connected to the gate of the driving transistor, and one of the source and the drain of the third transistor, wherein the other of the source and the drain of the third transistor is electrically connected to one of the source and the drain of the second transistor, and one of the pair of electrodes of the capacitor, wherein one of the source and the drain of the driving transistor is electrically connected to one of the pair of electrodes of the light-emitting element, the other of the pair of electrodes of the capacitor, and the other of the source and the drain of the second transistor, wherein each channel of the first transistor, the second transistor and the third transistor includes an oxide semiconductor layer, and wherein a reset signal is configured to be input to the gate of the second transistor to turn on the second transistor during a reset period after a period in which an image is displayed.

5. The display device according to claim 4, wherein a channel of the driving transistor includes an oxide semiconductor layer.

6. The display device according to claim 4, wherein the display device is incorporated in one selected from the group consisting of a portable game machine, a television receiver, a laptop personal computer, and a personal digital assistant.

* * * * *